US007762909B2

(12) United States Patent
Sugimoto

(10) Patent No.: US 7,762,909 B2
(45) Date of Patent: Jul. 27, 2010

(54) HOLLOW METAL GOLF CLUB HEAD AND METHOD FOR MANUFACTURING THE SAME

(75) Inventor: Yasushi Sugimoto, Kobe (JP)

(73) Assignee: SRI Sports Limited, Kobe (JP)

( * ) Notice: Subject to any disclaimer, the term of this patent is extended or adjusted under 35 U.S.C. 154(b) by 14 days.

(21) Appl. No.: 11/797,849

(22) Filed: May 8, 2007

(65) Prior Publication Data

US 2007/0287552 A1 Dec. 13, 2007

(30) Foreign Application Priority Data

Jun. 7, 2006 (JP) ..... 2006-158857

(51) Int. Cl.
*A63B 53/04* (2006.01)

(52) U.S. Cl. ..... 473/346; 473/350

(58) Field of Classification Search ..... 473/324–350
See application file for complete search history.

(56) References Cited

U.S. PATENT DOCUMENTS

| | | | | |
|---|---|---|---|---|
| 5,411,255 | A * | 5/1995 | Kurashima et al. | 473/332 |
| 5,419,559 | A * | 5/1995 | Melanson et al. | 473/346 |
| 5,482,279 | A * | 1/1996 | Antonious | 473/327 |
| 5,755,627 | A * | 5/1998 | Yamazaki et al. | 473/345 |
| 6,162,133 | A * | 12/2000 | Peterson | 473/345 |
| 6,334,817 | B1 * | 1/2002 | Ezawa et al. | 473/324 |
| 6,612,938 | B2 * | 9/2003 | Murphy et al. | 473/324 |
| 6,663,506 | B2 * | 12/2003 | Nishimoto et al. | 473/345 |
| 6,719,645 | B2 * | 4/2004 | Kouno | 473/345 |
| 6,875,126 | B2 * | 4/2005 | Yabu | 473/305 |
| 6,989,506 | B2 | 1/2006 | Yabu | |
| 7,059,973 | B2 * | 6/2006 | Erickson et al. | 473/345 |
| 7,066,835 | B2 * | 6/2006 | Evans et al. | 473/346 |
| 7,096,558 | B2 | 8/2006 | Sano | |
| 7,097,572 | B2 * | 8/2006 | Yabu | 473/329 |
| 7,160,205 | B2 * | 1/2007 | Yamamoto | 473/345 |
| 7,258,630 | B2 * | 8/2007 | Erickson et al. | 473/345 |
| 7,273,419 | B2 * | 9/2007 | Evans et al. | 473/328 |
| 7,303,488 | B2 * | 12/2007 | Kakiuchi et al. | 473/346 |
| 7,399,237 | B2 * | 7/2008 | Evans et al. | 473/328 |
| 7,435,191 | B2 * | 10/2008 | Tateno et al. | 473/346 |
| 7,479,070 | B2 * | 1/2009 | Hirano | 473/345 |
| 2003/0228932 | A1 * | 12/2003 | Ehlers et al. | 473/342 |

FOREIGN PATENT DOCUMENTS

| | | | |
|---|---|---|---|
| JP | 04292178 | A * | 10/1992 |
| JP | 11313906 | A * | 11/1999 |
| JP | 2000300703 | A * | 10/2000 |
| JP | 2000334071 | A * | 12/2000 |

(Continued)

*Primary Examiner*—Alvin A Hunter
(74) *Attorney, Agent, or Firm*—Birch, Stewart, Kolasch & Birch, LLP

(57) ABSTRACT

A hollow metal golf club head having a shell structure comprises a crown portion having a thickness gradually decreasing from the front edge toward the rear end of the head. A method of manufacturing the head comprises: making a face plate having an upper turnback which defines a front zone of the crown portion; making a crown plate which defines a back zone of the crown portion; making a hollow main shell having a front opening, a top opening and an in-between lateral frame defining a middle zone of the crown portion; and welding the face and crown plats to the main shell to cover the openings.

4 Claims, 5 Drawing Sheets

FOREIGN PATENT DOCUMENTS

| | | | | |
|---|---|---|---|---|
| JP | 2001104525 | A | * | 4/2001 |
| JP | 2002058762 | A | * | 2/2002 |
| JP | 2003180885 | A | * | 7/2003 |
| JP | 2004041376 | A | * | 2/2004 |
| JP | 2004065660 | A | * | 3/2004 |
| JP | 2005006698 | A | * | 1/2005 |
| JP | 2007325727 | A | * | 12/2007 |

* cited by examiner

Section E1

HOLLOW METAL GOLF CLUB HEAD AND METHOD FOR MANUFACTURING THE SAME

BACKGROUND OF THE INVENTION

The present invention relates to a hollow metal golf club head and a method for manufacturing the same, more particularly to a structure of the crown portion capable of increasing the carry distance of the struck ball.

In recent years, in order to increase the traveling distance (carry and run) of the struck ball, various propositions to improve the rebound performance of the head by increasing the coefficient of restitution of the face portion have been proposed for the wood-type golf club heads.

U.S. Pat. No. 7,096,558 discloses a wood-type hollow metal head which comprises: a main body provided with a front opening and formed by lost-wax precision casting; and a face plate provided with a turnback and formed by hot forging a metal material so as to improve the rebound performance and the durability of the face portion.

U.S. Pat. No. 6,989,506 discloses a wood-type golf club head (FIG. 9) which comprises: a main body made of a metal material and provided with a top opening and a front opening; a face plate made of a metal material and covering the front opening; and a crown plate made of a metal material and covering the top opening. The face plate and crown plate are welded to the main body by utilizing laser welding to improve the joint strength.

On the other hand, the current USGA golf rule limits the coefficient of restitution (COR) of a head such that the COR cannot be higher than 0.830. Therefore, we can not adopt a means of increasing the coefficient of restitution over the above limitation in order to increase the traveling distance of the struck ball.

SUMMARY OF THE INVENTION

The inventor made a study on the relationships between the traveling distance and factors other than the coefficient of restitution, and found that, by specifically arranging the rigidity distribution of the crown portion as well as the weight distribution of the crown portion, the lunch angle and backspin of the struck ball are optimized and the carry distance can be increased.

It is therefore, an object of the present invention to provide a hollow metal golf club head and a method of manufacturing the same, by which the carry distance can be increased.

According to one aspect of the present invention, a hollow metal golf club head having a shell structure comprising a face portion having a club face for striking a ball, a crown portion and a sole portion, wherein the crown portion has a thickness gradually decreasing from the front edge of the crown portion toward the rear of the head.

Under the standard state of the head, when measured on a vertical plane VP1 including the center G of gravity of the head and the sweet spot SS, a front zone (13*a*) of the crown portion has a thickness (t1*a*) in a range of 0.8 mm to 2.0 mm, and a back zone (1C) of the crown portion has a thickness (t3*a*) in a range of 0.2 mm to 1.0 mm, and a middle zone (4A) therebetween has a thickness between thicknesses (t1*a*) and (t3*a*) and having a maximum (t2*b*) at the front edge and a minimum (t2*b*) at the rear edge.

According to another aspect of the present invention, a method of manufacturing a hollow metal golf club head comprises the steps of: making a crown plate (1C) by a process including plastic forming a metal material, so that the crown plate has the thickness (t3*a*); making a face plate by a process including plastic forming a metal material so that the face plate is provided with an upper turnback (13*a*) extending backwards from an upper edge of a club face, and the upper turnback has the thickness (t1*a*); making a main shell by a process including casting a metal material so that the hollow main shell is provided with a front opening and a top opening, and a lateral frame (4A) is formed between the front opening and the top opening; and welding the crown plate and the face plate to the main shell so that the front opening and top opening are covered by the face plate and the crown plate, respectively, wherein the welding includes: welding of the rear edge of the upper turnback to the upper front edge of the front opening; and welding of the front edge of the crown plate to the front edge of the top opening, wherein the lateral frame (4A) has a thickness gradually decreasing backwards from a maximum (t2*f*) at the front edge to a minimum (t2*b*) at the rear edge, and the maximum (t2*f*) is substantially same as the thickness (t1) of the upper turnback at the rear edge, and the minimum (t2*b*) is substantially same as the thickness (t3) of the crown plate at the front edge.

DEFINITIONS

In the description, the dimensions refer to the values measured under the standard state of the club head unless otherwise noted.

The standard state of the club head 1 is such that the club head is set on a horizontal plane HP so that the axis CL of the clubshaft (not shown) is inclined at the lie angle while keeping the center line on a vertical plane VP2, and the club face 2 forms its loft angle alpha with respect to the horizontal plane HP. Incidentally, in the case of the club head alone, the center line of the shaft inserting hole 7*a* can be used instead of the axis of the clubshaft.

The back-and-forth direction is a direction parallel with the straight line N projected on the horizontal plane HP.

The heel-and-toe direction is a direction parallel with the horizontal plane HP and perpendicular to the back-and-forth direction.

The sweet spot SS is the point of intersection between the club face 2 and a straight line N drawn normally to the club face 2 passing the center G of gravity of the head.

The height H of the sweet spot SS is the vertical distance of the sweet spot SS from the horizontal plane HP.

The club face height FH is the vertical distance from the horizontal plane HP to the uppermost point of the upper edge 2*a* of the club face 2.

Edge of the club face: If the edge (2*a*, 2*b*, 2*c* and 2*d*) of the club face 2 is unclear due to smooth change in the curvature, a virtual edge line (Pe) which is defined, based on the curvature change is used instead as follows. As shown in FIGS. 14 and 15, in each cutting plane E1, E2 - - - including the straight line N extending between the sweet spot SS and the center G of gravity of the head, as shown in FIG. 15, a point Pe at which the radius (r) of curvature of the profile line Lf of the face portion first becomes under 200 mm in the course from the center SS to the periphery of the club face is determined. Then, the virtual edge line is defined as a locus of the points Pe.

The term "plastic forming" is for shaping a metal material by plastic deformation, and includes at least "forging" and "press working".

The "forging" means shaping achieved by beating a metal material with a hammer or die, and includes: cold forging carried out at a room temperature; warm forging carried out by heating the material to a temperature under the recrystallization temperature of the material; and hot forging carried out by heating the material to a temperature above the recrystallization temperature.

The "press working" means shaping achieved by cold-bending or cold-drawing a thin metal plate by the use of rollers, dies or the like, and includes "pressure molding" utilizing dies.

DESCRIPTION OF THE PREFERRED EMBODIMENTS

Figure 1:
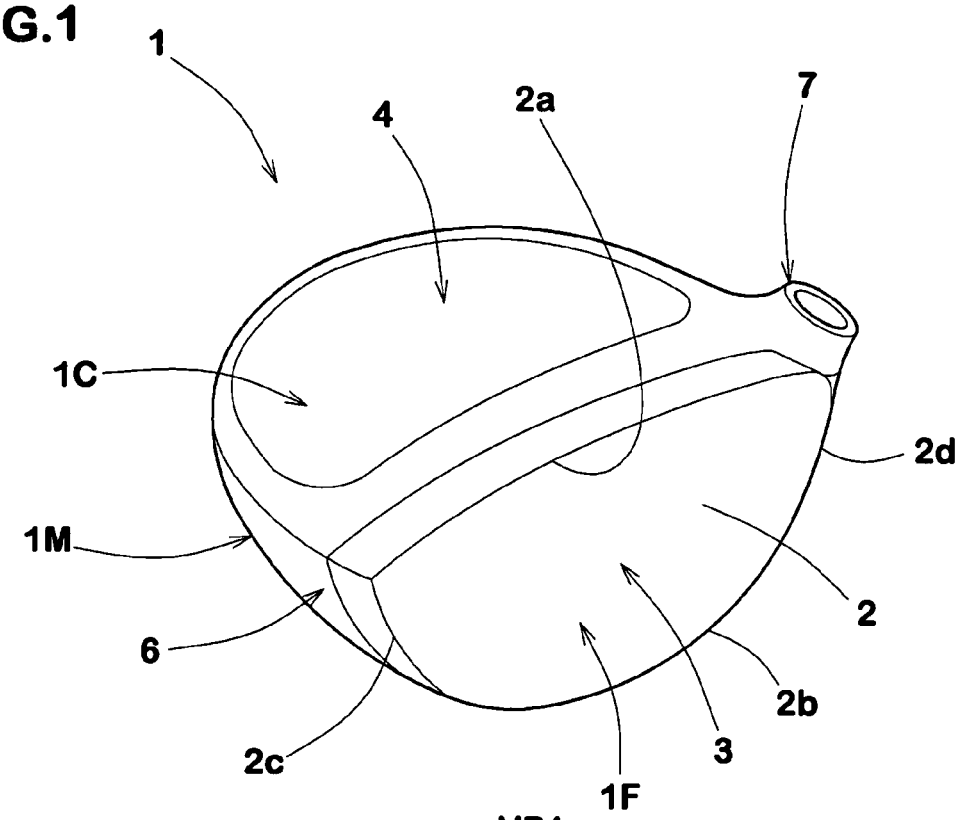
FIG. 1 is a perspective view of a wood-type hollow golf club head according to the present invention.

Embodiments of the present invention will now be described in detail in conjunction with the accompanying drawings.

In the drawings, golf club head 1 according to the present invention is a hollow head for a wood-type golf club such as driver (#1) or fairway wood, and the head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 at the heel side end of the crown to be attached to an end of a club shaft (not shown) inserted into the shaft inserting hole 7*a*. Thus, the club head 1 is provided with a hollow (i) and a shell structure with the thin wall.

In the case of a wood-type club head for a driver (#1), it is preferable that the head volume is set in a range of not less than 360 cc, more preferably not less than 380 cc in order to increase the moment of inertia and the depth of the center of gravity. However, to prevent an excessive increase in the club head weight and deteriorations of swing balance and durability and further in view of golf rules or regulations, the head volume is preferably set in a range of not more than 470 cc, more preferably not more than 460 cc.

The mass of the club head 1 is preferably set in a range of not less than 170 grams, more preferably not less than 180 grams in view of the swing balance and rebound performance, but not more than 250 grams, more preferably not more than 240 grams, still more preferably not more than 200 grams in view of the directionality and traveling distance of the ball.

* Structure of the Head 1

Figure 4:
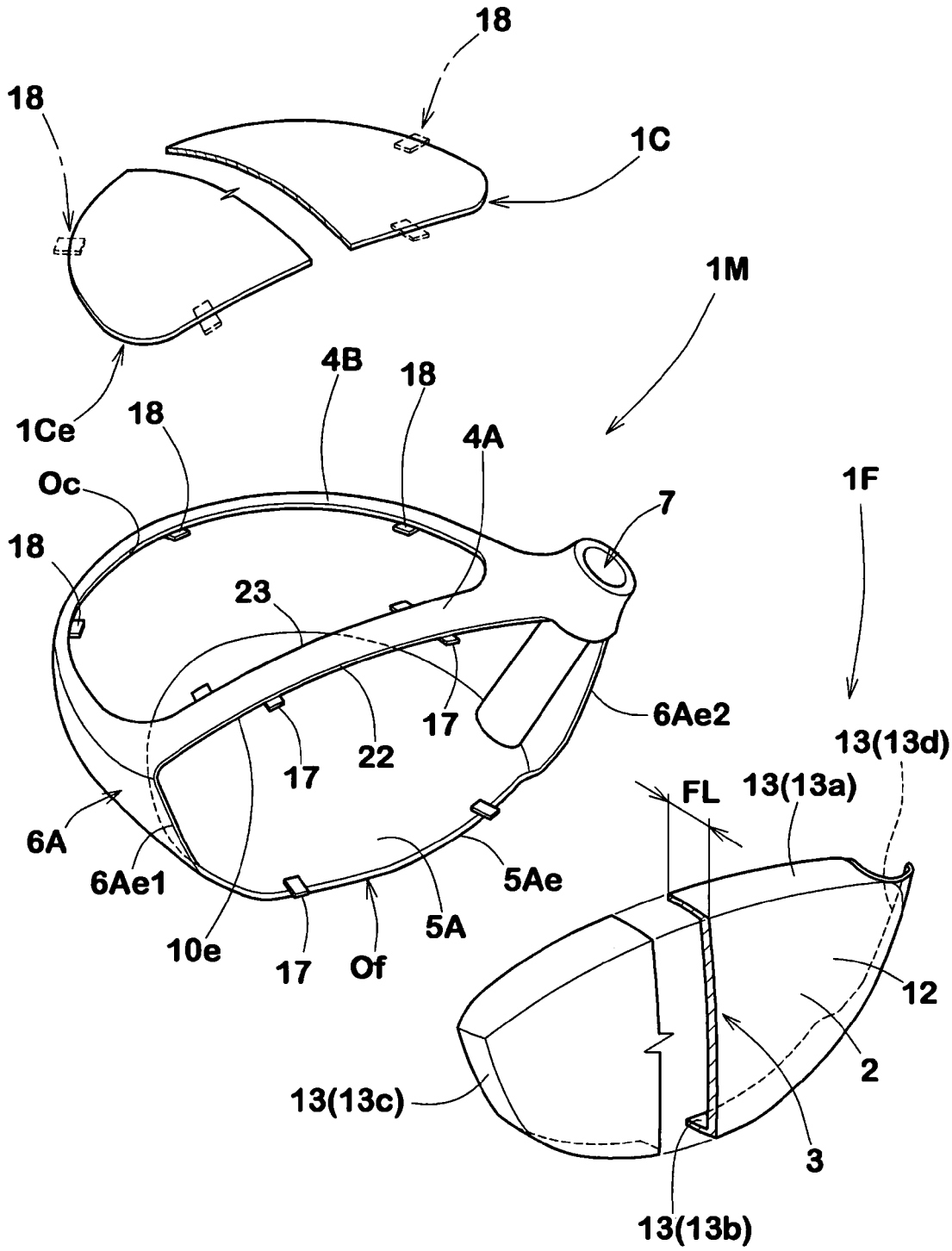
FIG. 4 is an exploded perspective view of the golf club head shown in FIG. 1.

As shown in FIG. 4, the golf club head 1 is assembled from: a main shell 1M provided with a front opening Of and a top opening Oc; a face plate 1F covering the front opening Of; and a crown plate 1C covering the crown opening Oc, wherein the face plate 1F and crown plate 1C are welded to the main shell 1M.

* Crown Plate 1C

The crown plate 1C is a slightly convexly curved thin plate made of a metal material.

For example, maraging steels, aluminum alloys, pure titanium and titanium alloys can be used. Preferably, titanium alloys such as Ti-15V-3Cr-3Al-3Sn, Ti-3Al-2.5V, Ti-15Mo-5Zr-3Al, Ti-10V-2Fe-3Al and Ti-6Al-4V can be used.

The crown plate 1C has a shape similar to but smaller in size than the shape of the contour of the crown portion 4.

Figure 2:
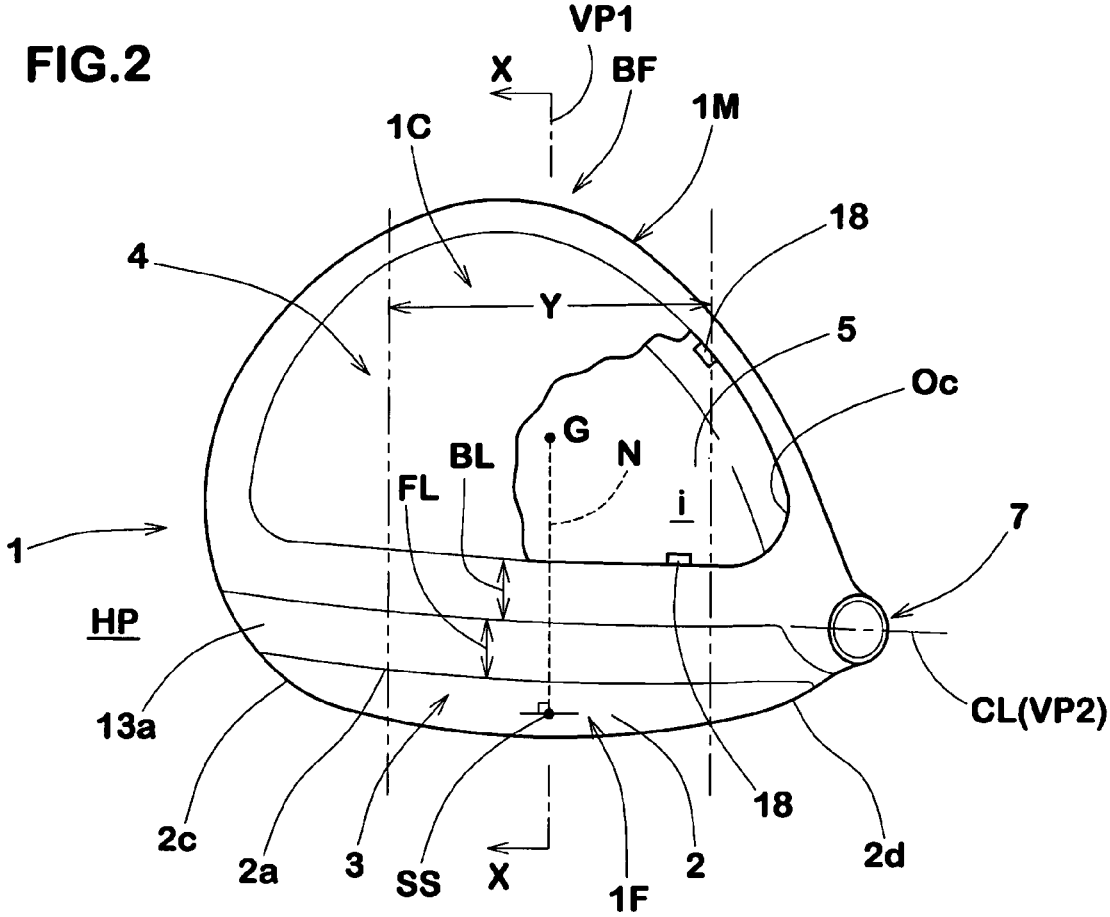
FIG. 2 is a top view thereof.

The projected area of the crown plate 1C on the horizontal plane HP is set in a range of 0.4 to 0.6 times the projected area of the head 1 on the horizontal plane HP as shown in FIG. 2.

The length RL of the crown plate 1C is set in a range of 0.5 to 0.7 times the length EL of the crown portion 4, when measured in the back-and-forth direction on the plane VP1 including the center G of gravity of the head and the sweet spot SS.

The thickness t3*a* of the crown plate 1C is preferably set in a range of not less than 0.2 mm, more preferably not less than 0.3 mm, still more preferably not less than 0.4 mm, but not more than 1.0 mm, more preferably not more than 0.8 mm, still more preferably not more than 0.7 mm.

If the thickness t3*a* is less than 0.2 mm, the strength and durability becomes insufficient, and further it is difficult to provide the necessary rebound performance. If more than 1.0 mm, on the other hand, it becomes difficult to increase the carry and the centre G of gravity of the head tends to become higher. In this embodiment, the thickness t3*a* is constant throughout the crown plate 1C. But, the thickness t3*a* can be varied within the above-mentioned range, for example, such that the central part has a reduced thickness small than the periphery edge.

In any case, the thickness t3*a* at the front edge 21 is referred to as "thickness t3".

As the crown plate 1C is formed with a small thickness to reduce the weight thereof, the crown plate 1C is formed by a process including plastic forming the above-mentioned metal material because the plastic forming can provide a high-strength homogeneous material in comparison with casting.

In this embodiment, the crown plate 1C is formed by:

preparing a rolled sheet of the above mentioned metal material having a constant thickness;

punching out a plate from the rolled sheet with punch cutting dies, which plate has a shape slightly larger than the finished shape of the crown plate 1C;

pressure molding the plate with shaping molds to provide the convex curvature; and trimming the edge of the plate with a NC milling machine to have the exact finished shape.

Of course, another method is also possible. For example, the crown plate 1C can be formed by: preparing a rolled sheet; cutting out a plate having the exact finished shape from the rolled sheet by lasering; and pressure molding the plate with shaping molds to provide the convex curvature.

* Face Plate 1F

The face plate 1F is provided with a turnback 13 integrally with its main part 12.

The main part 12 defines a major part of the face portion 3 including the sweet spot SS in its center. In this embodiment, the main part 12 defines the entirety of the face portion 3.

The turnback 13 is formed along at least the upper edge 2*a*. In this embodiment, the turnback 13 is formed along the almost entire length of the edge (2*a*, 2*b*, 2*c*, and 2*d*) of the face portion 3 excepting a part corresponding the hosel portion 7 as shown in FIG. 4. More specifically, the turnback 13 includes: an upper turnback 13*a* forming the front zone of the crown portion 3; a lower turnback 13*b* forming a front zone of the sole portion 4; a toe-side turnback 13*c* forming a front zone of the toe-side part of the side portion 5; and a heel-side turnback 13*d* forming a front zone of the heel-side part of the side portion 5.

The face plate 1F is made of a metal material having a large specific tensile strength such as titanium alloys, e.g. Ti-15V-6Cr-4Al, Ti-6Al-4V, Ti-13V-11Cr-3Al, Ti-5.5Al-1Fe, Ti-4.5Al-3V-2Fe-2Mo, Ti-4.5Al-2Mo-1.6V-0.5Fe and the like.

If the face portion 3 is too thick, the centre G of gravity of the head becomes shallow and the moment of inertia of the head becomes small. Therefore, the thickness tf of the main part 12 is preferably not more than 3.40 mm, more preferably not more than 3.35 mm, still more preferably not more than 3.30 mm. However, if the main part 12 is too thin, it is difficult to provide a necessary strength and durability. Therefore, the thickness tf is not less than 3.00 mm, more preferably not less than 3.05 mm, still more preferably 3.10 mm.

In this example, the thickness tf is substantially constant throughout the face portion 3. But, it is also possible that the face portion 3 has a variable thickness.

The turnback 13, especially upper turnback 13*a* is subjected to a large stress at impact. If the upper turnback 13*a* is too thin, the durability of the face portion is decreased. Further, if too thin, as the rigidity is decreased, the deflection at impact increases to increase the energy loss, and the rebound performance is deteriorated. If the upper turnback 13*a* is too thick, it goes against the lowering of the centre G of gravity.

Therefore, the thickness t1*a* of the upper turnback 13*a* is preferably set in a range of not more than 2.0 mm, more preferably not more than 1.5 mm, still more preferably not more than 1.2 mm, but, not less than 0.8 mm, more preferably not less than 0.9 mm.

The thickness t1*a* can be varied within this range so as to gradually decrease from the front to the rear. But, in this embodiment, the thickness t1*a* is substantially constant in the back-and-forth direction as well as the widthwise direction. In any case, the thickness t1*a* at the rear edge 20 is referred to as "thickness t1".

If the size of the upper turnback 13*a* in the back-and-forth direction of the head is too small, as the rigidity is decreases, the durability is decreased, and the energy loss at impact increases. If too large, it becomes difficult to increase the carry and the centre of gravity becomes high. Therefore, the length FL of the upper turnback 13*a* is preferably set in a range of not less than 0.05 times, more preferably not less than 0.07 times, but not more than 0.3 times, more preferably not more than 0.2 times the length EL of the crown portion 4.

Here, the length EL is the length in the back-and-forth direction measured under the standard state of the head horizontally along the vertical plane VP1 including the straight N from the upper edge 2*a* of the club face 2 to the extreme rear end of the head.

The length FL of the upper turnback 13*a* is measured in the back-and-forth direction of the head from the upper edge 2*a* of the club face 2 to the rear edge 20 of the upper turnback 13*a*.

In this embodiment, the length FL of the upper turnback 13*a* is substantially constant in the widthwise direction from the toe to the heel. But, it is not always necessary to have such constant length from the toe to the heel. It will be sufficient that the length FL is substantially constant within a range Y which is defined as having the width corresponding to the face height FH and centered on the sweet spot SS in the toe-heel direction when viewed from above the head as shown in FIG. 2. The above-mentioned length RL of the crown plate 1C is in a range of 3 to 5times the length FL.

The face plate 1F is formed by a process including plastic forming of the above-mentioned metal material because the face plate 1F, which is subjected to a large stress at impact, requires strength and durability, and the plastic forming can provide a high-strength homogeneous material in comparison with casting.

In this embodiment, as the turnback 13 is formed along the almost entire length of the edge of the main part 12, the crown plate 1C is formed by forging. More specifically, the crown plate 1C can be formed by: preparing a rolled sheet of the metal material having a constant thickness; punching out a plate from the rolled sheet with punch cutting dies; forging the plate with dies to provide the turnback 13 and also provide the above-described specific thickness distribution; and trimming the edge of the turnback with a NC milling machine to have the exact finished size and shape.

The crown plate 1C can be formed by bending without using dies in the case of for example the turnback 13 formed along the upper edge 2*a* only.

Since the turnback 13 can keep the weld junction position away from the club face 2, the effects of the heat during welding on the club face can be minimized.

* Main Shell 1M

Since the above-mentioned turnbacks (13*a*, 13*b*, 13*c*, 13*d*) form the front zones of the respective portions (3, 4, 5), the main shell 1M forms the remainder of the head.

In this embodiment, accordingly, the main shell 1M integrally includes: a major part 5A of the sole portion 5; a major part 6A of the side portion 6; a peripheral part 4B of the crown portion 4; and the above-mentioned hosel portion 7.

The main shell 1M is a casting of a metal material having a large specific tensile strength. Specifically, stainless steels (e.g. SUS630 etc.), maraging steels, aluminum base alloys, titanium alloys (e.g. Ti-6Al-4V etc.) and the like can be preferably used.

The thickness tp of the side major part 6A is not less than 0.50 mm, preferably not less than 0.60 mm in order to increase the moment of inertia of the head. But, if too thick, the weight margin of the head becomes too small. Therefore, the thickness tp is preferably not more than 2.0 mm, more preferably not more than 1.7 mm.

The thickness ts of the sole major part 5A is at least 0.60 mm, preferably not less than 0.80 mm to provide a necessary strength. But, if too thick, the weight margin of the head becomes too small. Therefore, the thickness ts is preferably not more than 1.5 mm, more preferably not more than 1.3 mm. Incidentally, a separate weight member may be fixedly provided on the sole major part 5A according to need.

The main shell 1M is formed by a process including casting. The main shell 1M can be formed by only casting such as lost-wax process precision casting. But, it is desirable that the sizes and shapes of the openings are adjusted with accuracy by utilizing machine work. Thus, it is preferable that the process of making the main shell 1M further includes machining.

In this embodiment, therefore, a primary casting 1Ma is first produced, which casting is provided with openings Of1, Oc1 smaller than the finished openings Of and Oc or alternatively provided with no opening. Thereafter, by machining the primary casting 1Ma, the provisional smaller openings Of1 and Oc1 are shaped into the openings Of and Oc, or alternatively the openings Of and Oc are formed. For that purpose, a numerical control machine tool is suitably used.

Of course it is also possible that one of the two openings Of and Oc is formed by casting and machining as explained above, and the other is formed by the casting only.

** Top Opening Oc

Either by the machining or by the casting only, the top opening Oc is formed within the crown portion 4, and thereby, the above-mentioned peripheral part 4B including a lateral frame 4A is formed.

The shape of the top opening Oc is almost same as but very slightly smaller than the shape of the crown plate 1C so that when the crown plate 1C is fitted in the top opening Oc the gap between their edges becomes less than about 0.5 mm, preferably almost zero. And the edges are butt-welded.

The lateral frame 4A is defined by a portion which is positioned between the top opening Oc and the front opening Of, and extends continuously from the toe to the heel to increase the stiffness of the main shell 1M.

** Front Opening Of

The front opening Of has an edge including: the upper front edge 22 of the lateral frame 4A; the lower front edge 5Ae of the sole major part 5A; and the toe-side and heel-side front edges 6Ae1 and 6Ae2 of the side major part 6A.

The shape of the edge of the front opening Of is the same as the shape of the edge of the face plate 1F, namely, the rear edge of the turnback. And the edges are butt-welded.

* Welding Method

Figure 3:
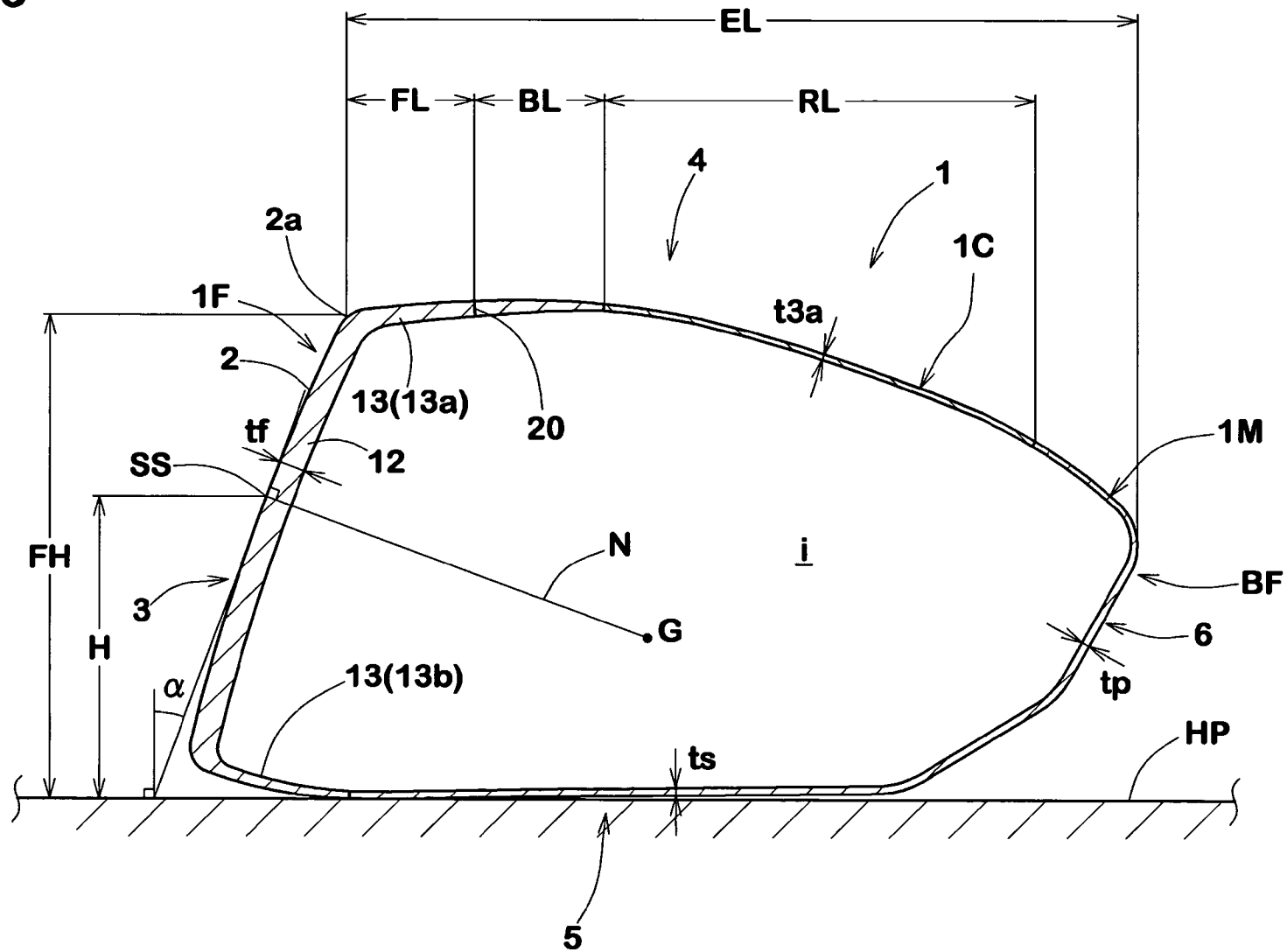
FIG. 3 is a cross sectional view taken along line x-x in FIG. 2, namely, the vertical plane VP including the center of gravity of the head and the sweet spot under the standard state of the head.

The face plate 1F and crown plate 1C are fixed to the main shell 1 by: butt-welding the edge of the face plate 1F to the edge of the front opening Of; and butt-welding the edge of the crown plate 1C to the edge of the top opening Oc, as shown in FIG. 3. For example, TIG welding, plasma welding and/or laser welding can be employed. Preferably plasma welding, more preferably laser welding is employed because it is easy to minimize the weld bead 19 occurring on the inside and outside of head. Thus, it is possible to save labor to remove the weld bead.

In order to facilitate the positioning of the face plate 1F during welding, the front opening Of is provided with clamping pieces 17 protruding from the edge of the opening and thereby being capable of fitting into the turnbacks of the face plate 1F. Also the top opening Oc is provided with clamping pieces 18 capable of fitting to the peripheral edge of the inner surface of the crown plate 1C and thereby positioning and supporting the crown plate 1C. The clamping pieces 17 and 18 are arranged along the edges of the openings at intervals.

It is however, also possible to provide such clamping pieces on the face plate 1F and/or crown plate.

During welding, there is a possibility that a weld bead is formed on the outside of the head and also on the inside of the head. The weld bead on the outside of the head is removed by grinding and polishing. But, the weld bead on the inside of the head can be remained if it is difficult to remove. In this case, the weld bead is not included in the above-mentioned thicknesses.

* Thickness Distribution

Therefore, the crown portion 4 comprises the front zone defined by the upper turnback 13*a*, the middle zone defined by the lateral frame 4A, and the back zone defined by the crown plate 1C.

Thicknesses of the Front Zone 13***a* and Back Zone 1C

The crown plate 1C namely back zone is very thin. But, the upper turnback 13*a* namely front zone is relatively thick. If the upper turnback 13*a* becomes too thick relatively to the crown plate 1C, then the increase in the weight of the crown portion 4 becomes remarkable, or the durability of the crown plate 1C is decreased. If the thickness t1*a* of the upper turnback 13*a* becomes close to the thickness t3*a* of the crown plate 1C, then it difficult to increase the carry and further it becomes difficult to improve the durability or reduce the weight of the crown portion 4.

Therefore, the thickness t1*a* is preferably set in a range of not less than 1.5 times, more preferably not less than 1.7 times, but not more than 4.0 times, more preferably not more than 3.0 times, still more preferably not more than 2.3 times the thickness t3*a* of the crown plate 1C.

Thickness of Middle Zone 4**A

The thicker upper turnback has a higher rigidity than the thin crown plate, and the lateral frame 4A namely middle zone is disposed therebetween.

In order to make the rigidity change gradual from the front to the rear of the crown portion, the lateral frame 4A has a thickness gradually decreasing from the front to the rear. The lateral frame 4A has: a maximum thickness t2*f* at the front edge 22 welded to the rear edge 20 of the upper turnback 13*a*; and a minimum thickness t2*b* at the rear edge 23 welded to the front edge of the crown plate 1C.

Figure 5:
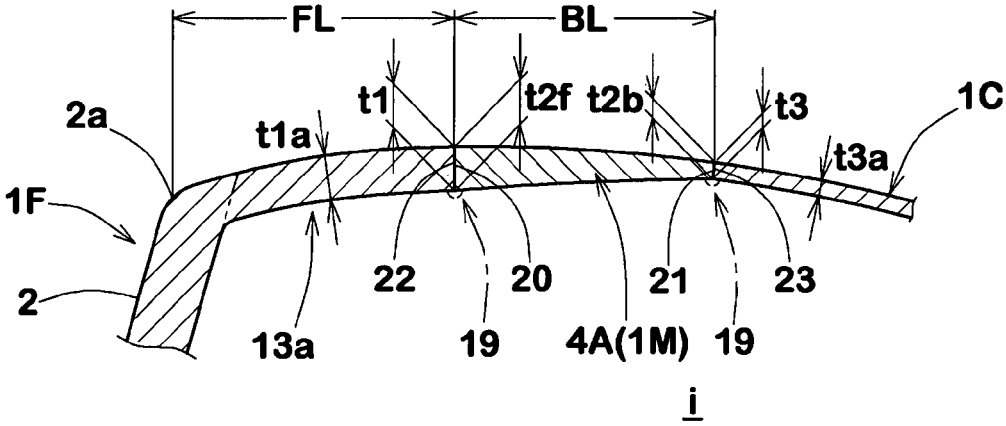
FIG. 5 is an enlarged cross-sectional view of a front half of the crown portion showing an example of the gradual thickness change.
Figure 6:
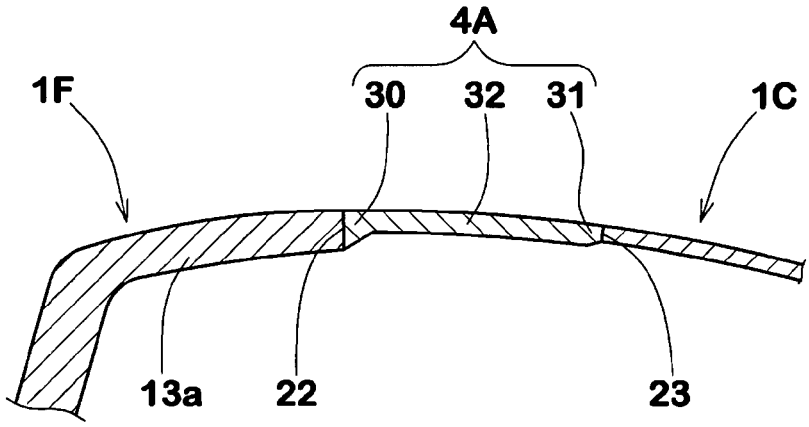
FIG. 6 is an enlarged cross-sectional view showing another example of the gradual thickness change.
Figure 7:
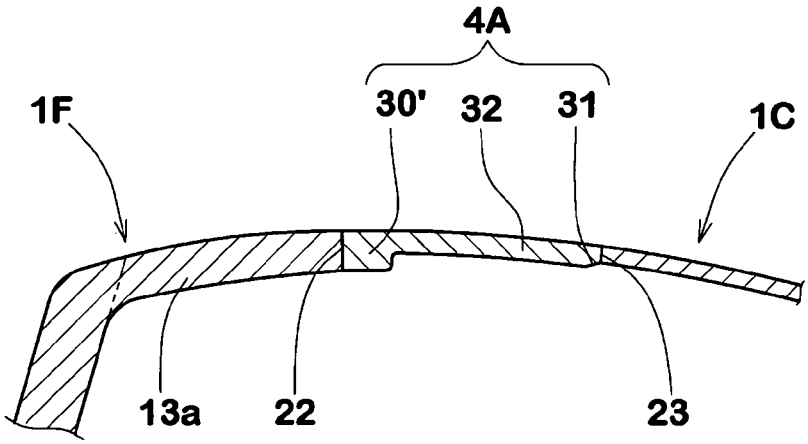
FIG. 7 is an enlarged cross-sectional view showing still another example of the gradual thickness change.
Figure 8:
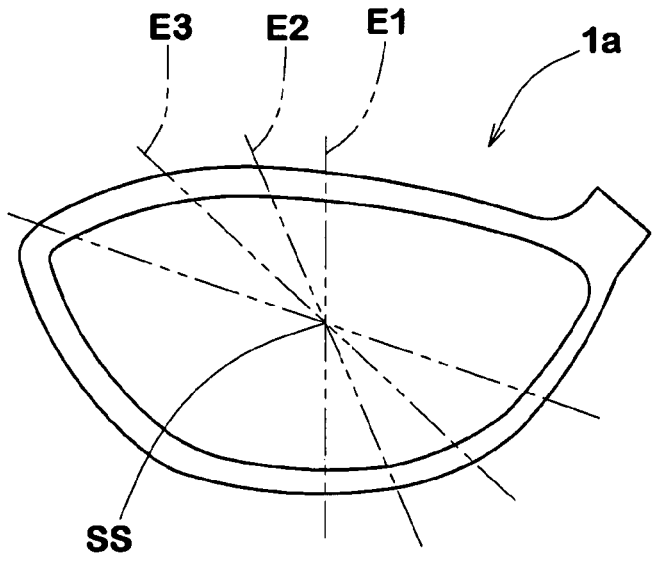
FIG. 8 and FIG. 9 are a front view and a partial cross sectional view of the face portion, respectively, for explaining the definition of the extent of the face portion.
Figure 9:
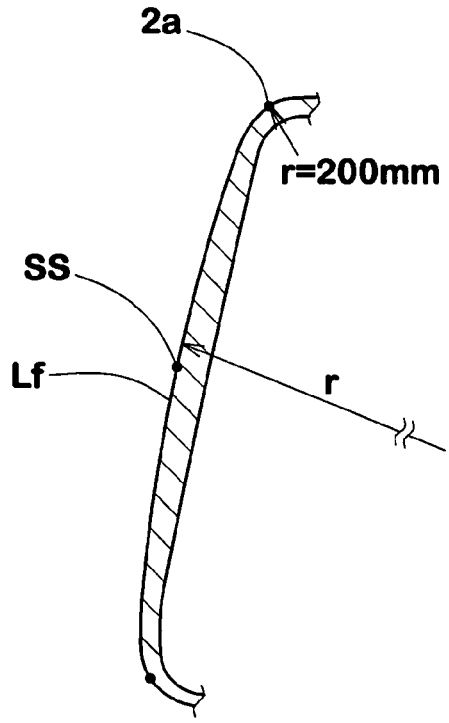

FIGS. 5-7 each show an example of the gradual decrease in the thickness from the maximum t2*f* to the minimum t2*b*.

In FIG. 5, the thickness continually decreases from the front edge 22 to the rear edge 23.

In FIG. 6, a major central portion 32 between a front edge portion 30 extending from the front edge 22 and a rear edge portion 31 extending to the rear edge 23 has a constant thickness. The front edge portion 30 and the rear edge portion 31 each have a variable thickness continuously decreasing from the respective front edge to rear edge.

In FIG. 7, a modification of the FIG. 6 structure is shown, wherein the major central portion 32 and the rear edge portion 31 are same as those in FIG. 6. But a front edge portion 30' has a constant thickness larger than that of the central portion 32. As a result, a step is formed between the front edge portion 30' and the central portion 32. The corners formed at the step are rounded by a small radius to avoid a stress concentration and the resultant damage such as cracks.

** Difference in Thickness Between the Butt-welded Edges

In any case, the absolute value of the difference |t2*b*−t3| between the thickness t2*b* of the lateral frame 4A at the rear edge 23 and the thickness t3 of the crown plate 1C at the front edge 21 is set in a range of not more than 0.2 mm, preferably not more than 0.1 mm, more preferably not more than 0.05 mm.

Similarly, the absolute value of the difference |t2*f*−t1| between the thickness t2*f* of the lateral frame 4A at the front edge 22 and the thickness t1 of the upper turnback 13*a* at the rear edge 20 is set in a range of not more than 0.2 mm. Preferably not more than 0.1 mm, more preferably not more than 0.05 mm. other than those above, the thickness difference between the edges to be butt-welded, for example, the difference between the rear edge of the crown plate 1C and the rear edge of the top opening Oc, the difference between the rear edge of the sole-side turnback 13*b* and the sole-side front edge of the front opening Of and the like, can be preferably set in the same range as above.

Preferably, a rate of thickness change (t2*f*–t2*b*)/BL which is the thickness difference (t2*f*–t2*b*) divided by the length BL of the lateral frame 4A, is set in a range of not less than 0.02, more preferably not less than 0.03, but not more than 0.1, more preferably not more than 0.06.

In this embodiment, the length BL is substantially constant across the almost entire width of the lateral frame 4A. But, it is not always necessary. It will be sufficient that the length BL is substantially constant within the above-mentioned range Y. Here, the length BL of the lateral frame 4A is measured in the back-and-forth direction of the head from the front edge 22 to the rear edge 23.

The length BL is in a range of 0.5 to 2 times the length FL of the upper turnback 13*a*.

As explained above, in the golf club head according to the present invention, the crown portion is provided with a thickness distribution such that the thickness is gradually decreased from the front edge toward the rear of the head. In the above-embodiments, further, the thickness of the face portion is larger than that of the turnback; therefore, the thickness is gradually decreased from the face portion to the rear of the head through the crown portion.

* Modification

In this embodiment, the edge of the front opening Of the main shell is positioned outside the face portion. But, it is also possible the edge of the front opening Of is partially positioned in the face portion.

* Comparison Tests

Hollow metal wood golf club heads having the structure shown in FIGS. 1-4 were made and tested for the carry, launch angle, backspin and durability.

Common specifications of the heads are as follows:

| Main shell: | |
|---|---|
| Material: | Ti—6Al—4V |
| Manufacturing process: | Lost-wax process precision casting |
| Lateral frame length BL: | 15 mm |

-continued

| Face plate: | |
|---|---|
| Material: | Ti—15V—6Cr—4Al ("DAT55G" Daido Steel Co., Ltd.) |
| Manufacturing process: | Forging |
| Upper turnback length FL: | 10 mm |
| Crown plate: | |
| Material: | Ti—15V—3Cr—3Sn—3Al (Kobe Steel, Ltd.) |
| Manufacturing process: | Pressure molding of Rolled sheet |
| Head volume: | 405 cc |
| Head weight: | 195 grams |
| Loft angle: | 11 degrees |
| Length EL of Crown portion: | 100 mm |
| Thickness tp of Side portion: | 0.8 mm |
| Thickness ts of Sole portion: | 1.2 mm |

Other specifications are shown in Table 1.

In each of the heads, the main shell, face plate and crown plate were laser welded or plasma welded as indicated in Table 1.

** Carry, Launch Angle and Backspin Test

Each head was attached to a CFRP shaft ("MP-300", SRI Sports Ltd.) to make a 45-inch wood club, and the golf club was mounted on a swing robot. Then, the head hit golf balls at the sweet spot five times at the head speed of 40 meter/second. The launch angle, backspin and carry of each ball were measured to obtain the respective mean values.

The results are shown in Table 1.

** Durability Test

The durability test was made by an increased head speed of 50 meter/second, using the above-mentioned clubs and swing robot. The head hit golf balls at the sweet spot 10000 times Max., while checking the weld junction every 1000 times. The results are shown in Table 1, wherein "A" means that no damage was found after the 10000-time hitting test, and numerical values mean the number of hitting times at which a damage was observed at the weld junction.

TABLE 1

| Head | Ref. 1 | Ref. 2 | Ex. 1 | Ex. 2 | Ex. 3 | Ex. 4 | Ex. 5 | Ex. 6 | Ref. 3 |
|---|---|---|---|---|---|---|---|---|---|
| Thickness | | | | | | | | | |
| Upper turnback t1a(=t1) (mm) | 1.2 | 0.40 | 1.2 | 1.2 | 0.90 | 1.2 | 1.2 | 1.2 | 1.2 |
| Lateral frame | | | | | | | | | |
| t2f @ front edge (mm) | 1.2 | 0.40 | 1.2 | 1.2 | 0.90 | 1.2 | 1.1 | 1.0 | 0.90 |
| t2b @ rear edge (mm) | 1.2 | 0.40 | 0.70 | 0.70 | 0.40 | 0.40 | 0.50 | 0.60 | 0.70 |
| Crown plate t3a(=t3) (mm) | 1.2 | 0.40 | 0.70 | 0.70 | 0.40 | 0.40 | 0.40 | 0.40 | 0.40 |
| t1 – t2f (mm) | 0.0 | 0.0 | 0.0 | 0.0 | 0.0 | 0.0 | 0.1 | 0.20 | 0.30 |
| t2b – t3 (mm) | 0.0 | 0.0 | 0.0 | 0.0 | 0.0 | 0.0 | 0.1 | 0.20 | 0.30 |
| t1a/t3a | 1.0 | 1.0 | 1.7 | 1.7 | 2.3 | 3.0 | 3.0 | 3.0 | 3.0 |
| Welding | laser | laser | laser | plasma | laser | laser | laser | laser | laser |
| Sweet spot height (mm) | 36.5 | 33.2 | 35.1 | 35.2 | 34.0 | 34.5 | 34.5 | 34.5 | 34.4 |
| Launch angle (deg.) | 12.1 | 13.7 | 12.6 | 12.5 | 13.2 | 13.0 | 13.0 | 13.0 | 13.1 |
| Backspin (rpm) | 3200 | 2000 | 2500 | 2500 | 2200 | 2300 | 2300 | 2300 | 2250 |
| Carry (yard) | 206 | 220 | 212 | 211 | 214 | 213 | 213 | 213 | 213.5 |
| Durability | A | 1000 | A | A | A | A | A | 9000 | 4000 |

From the test results, it was confirmed that, according to the invention, the strength and weight of the crown portion can be optimized, and the launch angle is increased while decreasing the backspin, and as a result, the carry is increased without sacrificing the durability.

In Ref. 1, although the durability was high, the backspin was increased and the carry became short. In Ref. 2, although the carry was long, the durability became remarkably lowered.

The invention claimed is:

1. A hollow metal golf club head having a shell structure comprising:

a face portion having a club face for striking a ball;

a crown portion; and a sole portion, wherein the crown portion has a thickness gradually decreasing from a front edge of the crown portion toward a rear end of the head, and the shell structure being made up of:

a main shell provided with a front opening and a top opening and having a lateral frame between the top opening and the front opening, a face plate provided with a turnback which is welded to the main shell and covering the front opening, and a crown plate welded to the main shell and covering the crown opening, wherein when measured on a vertical plane including a center of gravity of the head and a sweet spot under a standard state of the head, a front zone of the crown portion formed by said turnback has a thickness in a range of 0.8 mm to 2.0 mm and a length in a range of from 0.05 to 0.3 times a length of the crown portion, a back zone of the crown portion formed by said crown plate has a thickness in a range of 0.2 mm to 1.0 mm and a length in a range from 0.05 to 0.7 times the length of the crown portion, and a middle zone therebetween formed by said lateral frame has a length in a range of from 0.5 to 2 times the front zone length and a thickness in a range between the thicknesses of the front zone of the crown portion and the back zone of the crown portion, a butt-weld junction located between a rear edge of the turnback of the face plate and a front edge of the lateral frame of the main shell, wherein the thickness of the turnback at the rear edge is substantially the same as the thickness of the lateral frame at the front edge, a butt-weld junction located between a front edge of the crown plate and a rear edge of the lateral frame of the main shell, wherein the thickness of the crown plate at the front edge is substantially the same as the thickness of the lateral frame at the rear edge, and said thickness of the middle zone gradually decreases from the front edge thereof which has a maximum thickness to the rear edge thereof which has a minimum thickness, and the difference of the maximum thickness at the front edge of the middle zone from the minimum thickness at the rear edge of the middle zone is not less than 0.02 but not more than 0.1 times the length of the middle zone, wherein said standard state is such that the head is set on a horizontal plane so that a center line of a shaft insertion hole of the head is inclined at a lie angle of the head while keeping the center line on a vertical plane, and the club face forms its loft angle with respect to the horizontal plane.

2. The golf club head according to claim 1, wherein the front zone has the thickness which is substantially constant in the back-and-forth direction of the head, and the middle zone has the thickness decreasing continuously in the back-and-forth direction of the head from said front edge to said rear edge.

3. The golf club head according to 1, wherein the front zone has a thickness which is substantially constant in the back-and-forth direction of the head, and the thickness of the middle zone decreases stepwise in the back-and-forth direction of the head from said front edge to said rear edge.

4. The gold club head according to claim 1, wherein said main shell is a casting of a metal material, said face plate is a forged part or a press-molded part, and said crown plate is a forged part or a press-molded part.

* * * * *